US006053181A

United States Patent [19]

Ehlhardt et al.

[11] Patent Number: 6,053,181

[45] **Date of Patent: *Apr. 25, 2000**

[54] INSTRUMENT FOR STYLING HAIR

[75] Inventors: Huub Ehlhardt, Groningen; Lippe Van Den Brug, Drachten; Jacobus K. Westra, Groningen, all of Netherlands

[73] Assignee: U.S. Philips Corporation, New York, N.Y.

[ * ] Notice: This patent is subject to a terminal disclaimer.

[21] Appl. No.: 08/988,596

[22] Filed: Dec. 11, 1997

[30] Foreign Application Priority Data

Dec. 23, 1996 [EP] European Pat. Off. ..... 96203689

[51] Int. Cl.[7] ..... A45D 1/00; A45D 2/08; A45D 19/16; A45D 17/08

[52] U.S. Cl. ..... 132/269; 132/271; 132/272; 34/97

[58] Field of Search ..... 132/269, 271, 132/129, 272, 211, 107; 34/97, 98, 99, 96, 101

[56] References Cited

U.S. PATENT DOCUMENTS 5,894,849 4/1999 Ehlhardt et al. ..... 132/271

FOREIGN PATENT DOCUMENTS

94/09669 5/1994 WIPO ..... A45D 20/12

*Primary Examiner*—John J. Wilson
*Assistant Examiner*—Robyn Kieu Doan
*Attorney, Agent, or Firm*—Ernestine C. Bartlett

[57] ABSTRACT

An instrument for styling hair comprises a housing (9), a carrier (10, 11) which is movable supported by the carrier (10, 11), elongate hair guides (12, 13, 14) which project from the carrier (10, 11), a passage (15) for allowing hot air to pass through, and an air guide (17) which is controllable so as to direct the air stream in dependence upon forces exerted on the hair guides (12, 13, 14). The passage (15) and the carrier (10, 11) are adapted to influence the discharge direction in dependence upon the position of the carrier (10, 11) with respect to the housing (9). As the air guide (17) and the carrier (10, 11) are constructed in such a manner that the effective passage area of the passage (15) remains substantially constant when the discharge direction is changed, the air output and the temperature of the emerging air changes hardly when the discharge direction is changed. The hairstyle is better under control and less combing and brushing is necessary.

14 Claims, 3 Drawing Sheets

INSTRUMENT FOR STYLING HAIR

BACKGROUND OF THE INVENTION

The invention relates to an instrument for styling hair.

Such an instrument is known from WO-A-94/09669, the instrument comprising: at least one carrier which is movably supported by the housing, elongate hair guides which project from the carrier, at least one passage for discharging air in a discharge direction away from the housing, and at least one air guide for controlling the air flowing out of the passage in dependence upon forces exerted on the hair guides. The passage and the carrier are adapted to influence the discharge direction in dependence on the position of the carrier relative to the housing.

In the device according to said WO-A-94/09669 the discharge direction is influenced in dependence on movements of the hair guides with respect to the housing by selectively closing a number of differently oriented passages in the housing. For this purpose, the carrier from which the hair guides project is mounted so as to be pivotable past these passages and has passages arranged in such a manner that given ones of the differently oriented passages in the housing are closed selectively depending on the position of the carrier. Furthermore, the discharge direction of the air can be controlled by the controllable air guide device in dependence upon the forces exerted on the hair guides.

This known device exhibits the problem that the temperature of the outflowing air increases strongly while the instrument is moved through the hair.

SUMMARY OF THE INVENTION

It is an object of the invention to provide an instrument in which the temperature of the outflowing air remains relatively constant while the instrument is moved through the hair and by means of which the hair can be styled more rapidly and better.

According to the present invention this object is achieved in that the air guide and the carrier are constructed in such a manner that the effective passage area of the passage in a position of the carrier for deflecting the outflowing air is at least equal to the effective passage area of the passage in a position of the carrier for the substantially straight passage of the outflowing air.

Since the overall effective passage area of the passage or passages does not decrease but remains the same or increases when the discharge direction of the outflowing is changed the air output during use of an instrument in accordance with the invention remains substantially constant while the hair guides are moved through the hair.

In special embodiments of the invention, the instrument may comprise one or all of the following features:

An instrument for styling hair, comprising a housing, at least one carrier which is movably supported by the housing, elongate hair guides which project from the carrier, at least one passage for allowing air to pass through in a discharge direction away from the housing, and at least one air guide, which is controllable in dependence upon forces exerted on the hair guides, for directing the air flowing out through the passage, the passage and the carrier being adapted to influence the discharge direction in dependence upon the position of the carrier with respect to the housing, wherein:

(a) the air guide and the carrier are constructed in such a manner that the effective passage area of the passage in a position of the carrier for deflecting the outflowing air is at least equal to the effective passage area of the passage in a position of the carrier for the substantially straight passage of the outflowing air;

(b) the air guide and the carrier are constructed in such a manner that the effective passage area of the passage in a position of the carrier for deflecting the outflowing air is greater than the effective passage area of the at least one passage in a position of the at least one carrier for the substantially straight passage of the outflowing air;

(c) the air guide and the carrier are constructed in such a manner that the air resistance of the passage changes by less than 30% when the discharge direction changes;

(d) the at least one air guide is constructed as an air guide surface carried by the carrier;

(e) the air guiding surface is disposed between passages at opposite sides of said air guiding surface and is pivotable between a position oriented substantially transversely to the discharge direction and a position oriented more parallel to the discharge direction;

(f) the air guiding surface is curved at least in the plane in which it is pivotable;

(g) the carrier has a biconvex shape in a cross-section perpendicular to its pivotal axis;

(h) at least two carriers are present;

(i) coupling means which couple the carriers to one another so as to cause the carriers to be pivoted jointly is present;

(j) the carrier is supported so as to be pivotable about a pivotal axis with respect to the housing and the hair guides which project from the carrier are arranged in double rows of V-shaped cross-section, which are oriented parallel to said pivotal axis;

(k) the hair guides include coarse hair guides which form a comb and fine hair guides which form a brush;

(l) the housing has a coupling portion, which is remote from the hair guides, for coupling to a hair dryer unit;

(m) the instrument further comprises a hair dryer unit having an air inlet, a fan and a heating element for heating air which passes through and in which the air output does not change by more than 30% when the discharge direction changes; and (n) the housing also accommodates an air inlet, a fan and a heating element for heating air which passes through and in which the air output does not change by more than 30% when the discharge direction changes.

The instrument can be constructed, for example, as an attachment to be fitted onto a hair-dryer unit, as a one-piece hair dryer or hot-air brush, or as a combination of a hair-dryer unit with an attachment coupled thereto.

BRIEF DESCRIPTION OF THE DRAWINGS

The invention will be described in more detail hereinafter with reference to some embodiments given by way of examples, with reference to the drawings. In the drawings.

DESCRIPTION OF THE PREFERRED EMBODIMENTS

Figure 1:
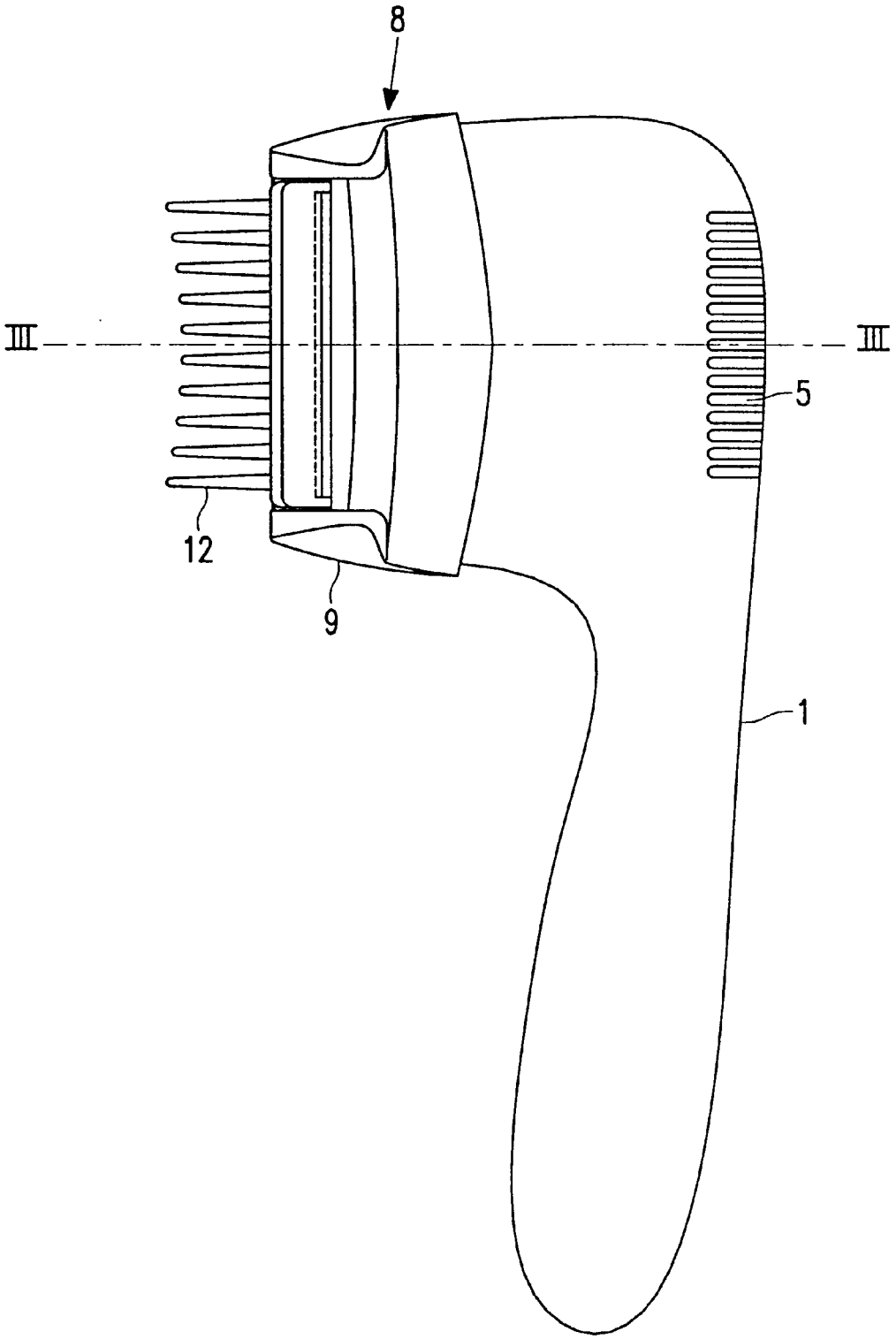
FIG. 1 is a side view showing a hair dryer equipped with an instrument in accordance with an embodiment of the invention.
Figure 2:
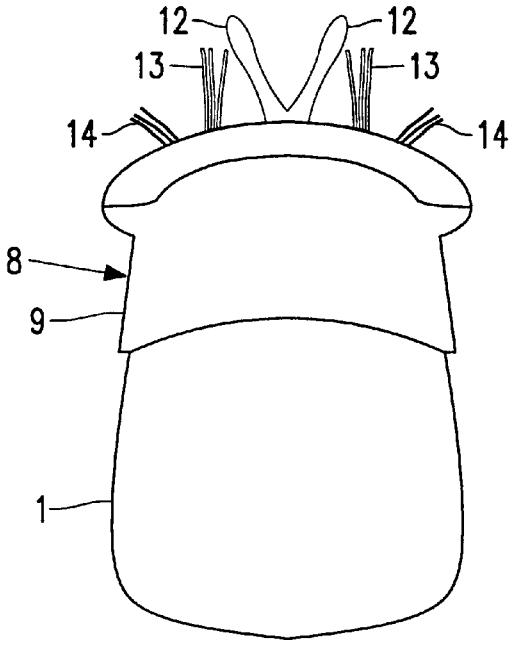
FIG. 2 is a side view of the same hair dryer, taken perpendicularly to the side view of FIG. 1.
Figure 3:
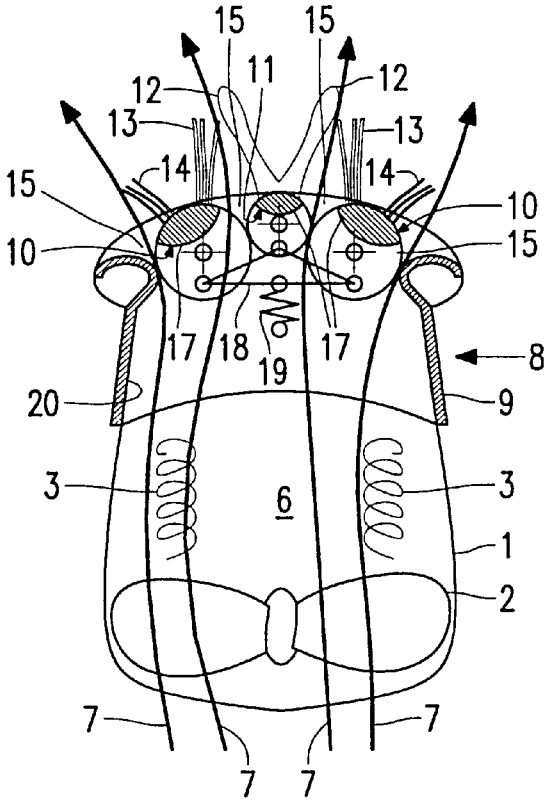
FIG. 3 is a diagrammatic sectional view taken on the line III—III in FIG. 1.

First of all, the instrument in accordance with the most preferred embodiment as shown FIGS. 1–4 will be described in detail and elucidated. Subsequently, attention will be paid to alternative embodiments as, for example, shown in FIG. 5. In the drawings like parts bear identical reference numerals.

FIGS. 1–4 show a device for styling the hair while it is being dried, which device is referred to hereinafter as a hair dryer for the sake of simplicity. The hair dryer comprises a hair dryer unit 1, which accommodates a fan 2 and heating elements 3. The fan 2 and the heating elements 3 are disposed in an air channel 6 which extends from air inlets 5 through the hair dryer unit 1. The air flowing through the channel 6 is represented by means of arrows 7, 7' in FIGS. 3 and 4.

An instrument for hair-styling, formed by an easy-to-exchange attachment 8, is mounted on the hair dryer unit 1. This attachment 8 comprises inter alia a housing 9, carriers 10, 11 which are pivotably supported by the housing 9, and elongate hair guides 12, 13, 14 which project from the carriers 10, 11. The hair guides 13, 14 are not shown in FIG. 1. The attachment 8 further has passages 15 for hot air in discharge directions away from the housing 8 (which directions are indicated by parts of the arrows 7, 7" in the area of the passages 15). The hair guides 12, 13, 14 form combs and brushes for ordering and styling the hair.

Figure 4:
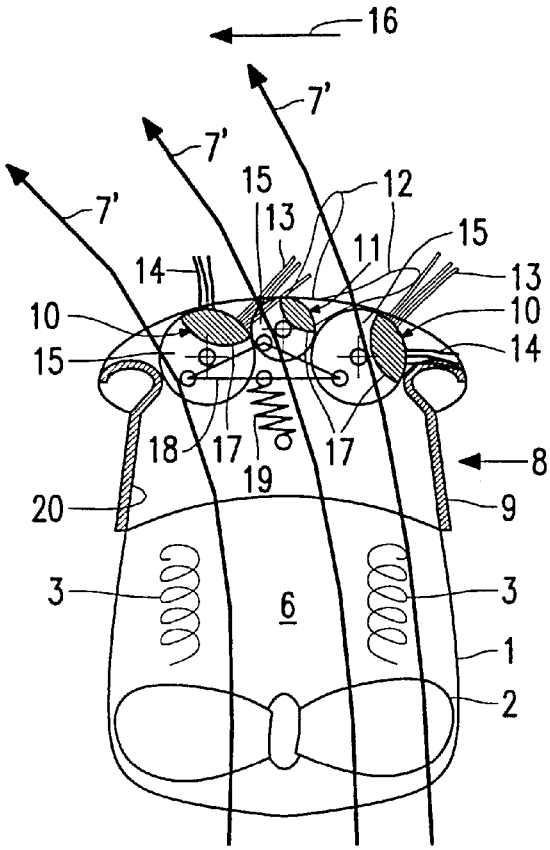
FIG. 4 is a view similar to FIG. 3 in another operating condition.

The carriers 10, 11 are adapted to influence the passages 15 in such a manner that a pivotal movement of the carriers 10, 11 with the hair guides 12, 13, 14, which project therefrom, in a first direction relative to the housing 8 results in a change of the direction of the air stream 7, 7' in the area of the passages 15 in a second substantially opposite direction. If, for example as is shown in FIG. 4, the combs and brushes formed by the hair guides 12, 13, 14 and the carriers 10, 11 from which they project are pivoted to the right in that the hair dryer is moved through the hair to the left (in the direction indicated by an arrow 16), the air stream 7' leaving the passages 15 is also directed to the left. As a result of this, it is always directed in the combing direction. The effect of this is that during combing and/or brushing of the hair the air stream is guided past the head in a more parallel direction than in the case that it simply issues frontally from the attachment 8, and that hair which has been forced into a certain position by the hair guides 12, 13, 14 is not immediately blown out of this position as soon as it is freed from the hair guides 12, 13, 14. This results in a better styling control, a more rapid styling and less loss of resilience of the hair since the hair needs to be heated, brushed and combed less frequently in order to obtain a desired hair-style. Since in the case that the proposed attachment 8 is used the nearly dry hair is first heated and is given the desired orientation and shape by means of the hair guides 12, 13, 14 in the heated condition, a better hair-styling performance is achieved.

For influencing the direction in which the air stream 7, 7' flows through the passages 15 the attachment 8 has air guiding surfaces 17 which are pivoted when the carriers 10, 11 are pivoted.

The discharge area of the passages does not decrease when the discharge direction is changed, as a result of which the air flow is not reduced or only to a very small extent when the discharge direction is changed. In its turn, this has the advantage that, when the discharge direction is changed and the heating elements 3 deliver a constant power, the temperature of the outflowing air decreases or hardly increases. It is of particular importance that in this way a sudden excessive heating of the scalp and the hair is prevented.

In the proposed hair-styling instrument the effective area of the passages 15 increases when the direction of the outflowing air 7' is changed. This has the advantage that the increase in air resistance caused by the fact that the air stream is deflected is compensated by the increase in the overall effective passage area. Thus, variations in air output owing to the deflection of the air stream can remain limited.

In order to obtain a simple construction of the attachment 8 the air guiding surfaces 17 have been arranged on the carriers 10, 11.

In the proposed attachment 8 deflection of the outflowing air in a direction opposite to that in which the hair guides 12, 13, 14 are pivoted is achieved in that the air guiding surfaces 17 are each arranged between passages 15 at opposite sides thereof and are each pivotable from a position oriented substantially transversely to the discharge direction to a position oriented more parallel to the discharge direction. In the position oriented transversely to the discharge direction the air guiding surfaces 17 divide the inflowing air substantially uniformly into air streams which flow past these air guiding surfaces 17 and the relevant carriers 10, 11 (see FIG. 3). When the hair guides 12, 13, 14 and hence the carriers 10, 11 are pivoted, the air guiding surfaces 17 are tilted from a position oriented substantially transversely to the air stream 7 to a position oriented obliquely relative the air stream 7', as a result of which the air stream is deflected mainly in one direction.

The air guiding surfaces 17 are curved at least in the plane in which they are pivotable, i.e. about the respective pivotal axes. This has the advantage that the air guiding surfaces 17 present a comparatively low air resistance. Moreover, the air resistance presented by the air guiding surfaces 17 is comparatively constant.

Furthermore, as the carriers 10, 11 have a biconvex cross-sectional shape they form wing profiles in the tilted position, the surfaces of the carriers 10, 11 at the sides of the hair guides 12, 13, 14 also contributing to the deflection of the air stream 7'.

Although the number of carriers can be limited to one, the use of two or more carriers 10, 11 has the advantage that the carriers can be pivoted to a considerable extent and, as a consequence, the direction in which the air stream 7, 7' issues can be influenced considerably without the main outline of the attachment 8 being changed significantly. A limited change of the main outline promotes the ease of handling of the instrument.

The carriers 10, 1 1 are coupled to one another by coupling means 18, which couple the carriers 10, 11 so as to cause these carriers 10, 11 to be pivoted jointly. As soon as one of the carriers 10, 11 is pivoted under the influence of the force exerted by the hair on the hair guides 12, 13 or 14 which project from this carrier 10, 11, the other one of the carriers 10, 11 is thus moved along, as a result of which an effective change of the direction in which the air stream issues is obtained. Moreover, it is thus prevented that the air resistance caused by the carriers 10, 11 is increased in that these carriers deflect the air stream 7, 7' in opposite directions.

In order to ensure that the carriers 10, 11 are each time pivoted back to the neutral position, a resilient element 19 is arranged between the coupling 18 for the carriers 10, 11 and the housing 9, which resilient element urges the carriers 10, 11 into a neutral position. As a result, the air issues frontally from the attachment 8 once the attachment 8 has been taken out of the hair.

The hair guides 12, 13, 14 which project from the carriers 10, 11 are arranged in double rows of V-shaped cross-section, which are oriented parallel to the pivotal axis of the carriers 10, 11. As a result of this arrangement, it is achieved that, even if the carriers 10, 11 have been pivoted fully to one side, as is shown in FIG. 4, a number of the hair guides project substantially perpendicularly from the main outline of the attachment 8 and effectively act upon the hair to be styled.

As the attachment comprises coarse hair guides 12, which form a comb, and fine hair guides 13, 14, which form brushes, the attachment can also be used for styling and drying very wet hair, into which the brushes cannot readily penetrate. The effect of the brushes increase gradually as the hair dries. It is then advantageous that the coarse hair guides 12 project farther from the main outline of the attachment than the finer hair guides 13, 14, so that the coarse hair guides 12 of the comb can also be introduced properly into hair when the fine hair guides 13, 14 of the brushes cannot yet properly penetrate into the hair.

At its side which is remote from the hair guides 12, 13, 14, the housing 8 has a coupling portion 20 for coupling to a hair dryer unit, as a result of which the attachment can be exchanged simply. Such a hair dryer unit 1 preferably has a heating element having a power of at least 800 W, so that rapid drying is achieved but sufficient time is left for styling and, when the hair is nearly dry, excessive heating of the head and the hair is prevented.

Figure 5:
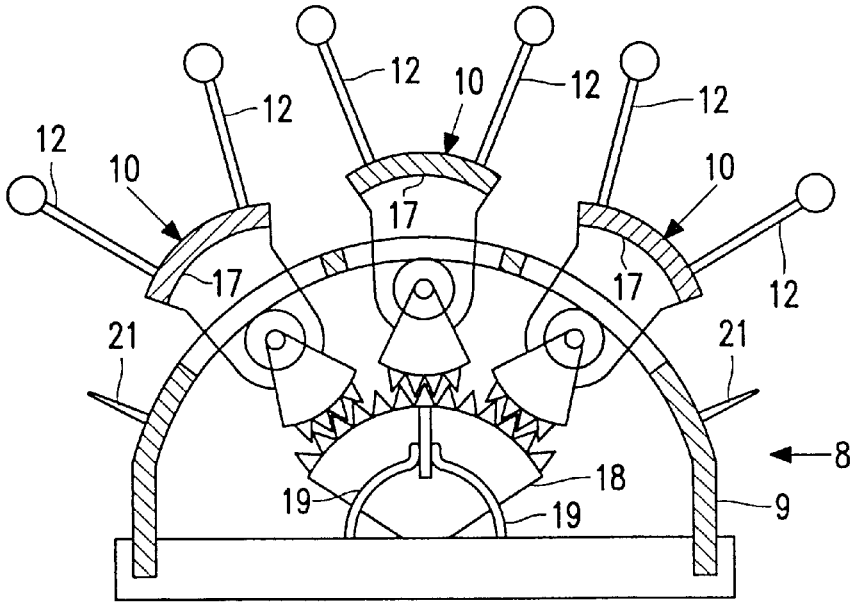
FIG. 5 is a sectional view of an alternative embodiment of the instrument in accordance with the invention.

In the example shown in FIG. 5 the hair guides are all identical, the air guiding surfaces have concave instead of convex shapes, and the coupling between the carriers is constructed as a pivotable element having a toothed segment which meshes with toothed segments of the carriers 10. The resilient element for urging the carriers into the neutral position is also arranged between the housing 9 and the coupling 18 but is constructed as a pair of cooperating blade springs 19 instead of as a helical spring. In order to obtain extra grip on the hair to be styled, the housing has been provided with fixed hair guides 21 at opposite sides of the rows of pivotable hair guides 12.

In the examples shown herein the instrument has been constructed as an attachment adapted to be mounted on a hair dryer unit. However, the instrument can also be constructed in such a manner that the housing also accommodates an air inlet, a fan and a heating element for heating air which passes through and is consequently integral with and, at least in normal use, not detachable from the hair dryer unit.

We claim:

1. An instrument for styling hair, comprising a housing, at least one carrier which is movably supported by the housing, elongate hair guides which project from the carrier, at least one passage for allowing air to pass through in a discharge direction away from the housing, and at least one air guide, which is controllable in dependence upon forces exerted on the hair guides, for directing the air flowing out through the passage, the passage and the carrier being adapted to influence the discharge direction in dependence upon the position of the carrier with respect to the housing, wherein the air guide and the carrier are constructed in such a manner that the effective passage area of the passage in a position of the carrier for deflecting the outflowing air is at least equal to the effective passage area of the passage in a position of the carrier for the substantially straight passage of the outflowing air.

2. An instrument as claimed in claim 1, in which the air guide and the carrier are constructed in such a manner that the effective passage area of the passage in a position of the carrier for deflecting the outflowing air is greater than the effective passage area of the at least one passage in a position of the at least one carrier for the substantially straight passage of the outflowing air.

3. An instrument as claimed in claim 1, in which the air guide and the carrier are constructed in such a manner that the air resistance of the passage changes by less than 30% when the discharge direction changes.

4. An instrument as claimed in claim 1, in which the at least one air guide is constructed as an air guide surface carried by the carrier.

5. An instrument as claimed in claim 1, in which the air guiding surface is disposed between passages at opposite sides of said air guiding surface and is pivotable between a position oriented substantially transversely to the discharge direction and a position oriented more parallel to the discharge direction.

6. An instrument as claimed in claim 5, in which the air guiding surface is curved at least in the plane in which it is pivotable.

7. An instrument as claimed in claim 6, in which the carrier has a biconvex shape in a cross-section perpendicular to its pivotal axis.

8. An instrument as claimed in claim 1, comprising at least two of said carriers.

9. An instrument as claimed in claim 8, further comprising coupling means which couple the carriers to one another so as to cause the carriers to be pivoted jointly.

10. An instrument as claimed in claim 1, in which the carrier is supported so as to be pivotable about a pivotal axis with respect to the housing and the hair guides which project from the carrier are arranged in double rows of V-shaped cross-section, which are oriented parallel to said pivotal axis.

11. An instrument as claimed in claim 10, in which the hair guides include coarse hair guides which form a comb and fine hair guides which form a brush.

12. An instrument as claimed in claim 1, in which the housing has a coupling portion, which is remote from the hair guides, for coupling to a hair dryer unit.

13. An instrument as claimed in claim 1, further comprising a hair dryer unit having an air inlet, a fan and a heating element for heating air which passes through and in which the air output does not change by more than 30% when the discharge direction changes.

14. An instrument as claimed in claim 1, in which the housing also accommodates an air inlet, a fan and a heating element for heating air which passes through and in which the air output does not change by more than 30% when the discharge direction changes.

* * * * *